US007482571B2

(12) United States Patent
Thomas

(10) Patent No.: US 7,482,571 B2
(45) Date of Patent: Jan. 27, 2009

(54) LOW COST PLANAR IMAGE INTENSIFIER TUBE STRUCTURE

(75) Inventor: Nils Ian Thomas, Roanoke, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 159 days.

(21) Appl. No.: 11/194,865

(22) Filed: Aug. 1, 2005

(65) Prior Publication Data

US 2007/0023617 A1 Feb. 1, 2007

(51) Int. Cl.
*H01J 31/50* (2006.01)
*H01J 43/30* (2006.01)

(52) U.S. Cl. ..... 250/214 VT; 313/543; 313/528; 313/103 CM; 313/103 R; 250/239

(58) Field of Classification Search ..... 250/214 VT; 313/543, 528, 103 CM
See application file for complete search history.

(56) References Cited

U.S. PATENT DOCUMENTS 4,039,877 A * 8/1977 Wimmer ..... 313/528
4,198,225 A * 4/1980 Patrick et al. ..... 65/43
5,329,110 A * 7/1994 Shimabukuro et al. ..... 250/207
5,493,111 A * 2/1996 Wheeler et al. ..... 250/207
5,510,673 A 4/1996 Wodecki et al.
5,731,660 A * 3/1998 Jaskie et al. ..... 313/495
5,986,387 A * 11/1999 Niigaki et al. ..... 313/103 R
5,994,824 A 11/1999 Thomas et al.
6,040,657 A * 3/2000 Vrescak et al. ..... 313/544
6,140,574 A * 10/2000 Snyder ..... 174/368
6,331,753 B1 * 12/2001 Iosue ..... 313/542
6,483,231 B1 * 11/2002 Iosue ..... 313/103 CM
6,586,877 B1 * 7/2003 Suyama et al. ..... 313/523
6,724,131 B2 4/2004 Iosue
6,747,258 B2 * 6/2004 Benz et al. ..... 250/207
6,837,766 B2 1/2005 Costello
6,847,027 B2 1/2005 Iosue
2004/0245925 A1 * 12/2004 Yamauchi et al. ..... 313/532
2005/0087676 A1 * 4/2005 Shimoi et al. ..... 250/214 VT
2005/0106983 A1 5/2005 Iosue
2005/0140269 A1 * 6/2005 Hwang ..... 313/497

OTHER PUBLICATIONS

European Search Report Appln. No. 06118193.9-2208 dated Feb. 2, 2007.

* cited by examiner

*Primary Examiner*—Seung C Sohn
(74) *Attorney, Agent, or Firm*—Ratner Prestia

(57) ABSTRACT

An image intensifier tube is provided. The image intensifier tube has a microchannel plate (MCP), a photocathode and phosphor screen deposited on a fiber optic substrate. A first spacer is positioned between the microchannel plate and the fiber optic substrate. A second spacer is positioned between the fiber optic substrate and the photocathode. The first and second spacers cooperate to provide a spatial relationship among the MCP, phosphor screen and photocathode for effective operation of the image intensifier tube.

47 Claims, 9 Drawing Sheets

LOW COST PLANAR IMAGE INTENSIFIER TUBE STRUCTURE

FIELD OF THE INVENTION

This invention relates to a low cost planar image intensifier tube for use in night vision systems.

BACKGROUND OF THE INVENTION

Night vision systems are used in a wide variety of military, industrial and residential applications to enable sight in a dark environment. For example, night vision systems are utilized by military aviators during nighttime flights. Security cameras use night vision systems to monitor dark areas and medical instruments use night vision systems to alleviate conditions such as retinitis pigmentosis (night blindness).

Image intensifier devices are employed in night visions systems to convert a dark environment to an environment perceivable by a viewer. More specifically, the image intensifier device within the night vision system collects tiny amounts of light in a dark environment, including the lower portion of the infrared light spectrum, that are present in the environment but may be imperceptible to the human eye. The device amplifies the light so that the human eye can perceive the image. The light output from the image intensifier device can either be supplied to a camera, external monitor or directly to the eyes of a viewer. The image intensifier devices are commonly employed in vision goggles that are worn on a user's head for transmission of the light output directly to the viewer. Accordingly, since the goggles are worn on the head, they are desirably compact and light weight for purposes of comfort and usability.

Image intensifier devices include three basic components mounted within a housing, i.e. a photocathode (commonly called a cathode), a microchannel plate (MCP), and a phosphor screen (commonly called a screen, fiber-optic or anode). The photocathode detects a light image and converts the light image into a corresponding electron pattern. The MCP amplifies the electron pattern and the phosphor screen transforms the amplified electron pattern back to an enhanced light image.

The photocathode is a photosensitive plate capable of releasing electrons when it is illuminated by light. The number of electrons released by the photocathode is proportional to the intensity of the light impinging on it. The photocathode operates by the principles of the photoelectric effect. More specifically, when a light photon enters the photocathode material and the energy of the photon exceeds the binding energy of an electron to an atom on the surface of the photocathode, the electron is excited from the valence band to the conduction band of the photocathode. The electron is then emitted from the photocathode unto the micro-channel plate.

The MCP is a thin glass plate having an array of channels extending between one side (input) and another side (output) of the glass plate. The MCP is positioned between the photocathode and the phosphor screen. An incoming electron from the photocathode enters the input side of the MCP and strikes a channel wall. When voltage is applied across the MCP, these incoming or primary electrons are amplified, generating secondary electrons. The secondary electrons exit the channel at the output side of the MCP and are accelerated towards the phosphor screen.

The secondary electrons exiting the MCP channel are negatively charged and are therefore, attracted to the positively charged phosphor screen, which is coated with phosphor. It should be understood that phosphor is any material that emits light when exposed to electron radiation. The energy of the secondary electrons colliding with the phosphor screen causes the phosphor on the screen to reach an excited state and release photons proportional to the quantity of the secondary electrons. The phosphor on the screen glows when photons are released. An eyepiece lens typically magnifies and collimates the glowing phosphor image. A fiber optic inverter element positioned adjacent to the objective lens may invert the phosphor image for viewing through a goggle eyepiece.

The three basic components of the image intensifier device are positioned within an evacuated housing or vacuum envelope. The vacuum facilitates the flow of electrons from the photocathode through the MCP and to the phosphor screen. The photocathode MCP and phosphor screen are electrically biased so that the phosphor screen is maintained at a higher positive potential than the photocathode. Furthermore, the photocathode, MCP and phosphor screen are each maintained at different electrical potentials. All three components are electrically isolated from one another, while being retained within the vacuum housing.

Referring to FIG. 1, there is shown a cross-sectional view of a conventional Generation III image intensifier tube 10 of the type currently manufactured by ITT Industries Night Vision of Roanoke, Va. The Generation III image intensifier tube 10 includes evacuated housing 12 made from an assemblage of several components. Within housing 12, there is positioned photocathode 14', microchannel plate (MCP) 16, and inverting fiber optic element 18, which supports phosphor screen 20. The construction of vacuum housing 12 usually includes at least eighteen separate elements stacked atop one another and joined to form an air tight envelope between photocathode 14' and fiber optic element 18.

The photocathode is attached to faceplate 15' having a sloped portion 15A' and a flat portion 24' which rests upon a conductive support ring 22 at one end of vacuum housing 12. A metalized layer 25, generally composed of chrome, is deposited upon flat portion 24' to conductively engage support ring 22. Metalized layer 25 extends continuously along sloped portion 15A' to conductively engage both photocathode 14' and faceplate 15' at interface 19. The abutment of the photocathode faceplate against support ring 22 creates a seal to close one end of vacuum housing 12. The support ring 22 contacts metalized surface 24' on the faceplate of photocathode 14'. The metalized surface 24', in turn, is coupled to a photoresponsive layer 26 by means of the chrome deposited layer 25 on photocathode 14' contained within the evacuated environment of vacuum housing 12. As such, an electrical bias may be applied to photoresponsive layer 26 of photocathode 14' within the evacuated environment by applying an electrical bias to support ring 22 on the exterior of vacuum housing 12.

A first annular ceramic spacer 28 is positioned below support ring 22. The first ceramic spacer is joined to support ring 22 by a first copper brazing ring 31, which is joined to both the first ceramic spacer and support ring 22 during a brazing operation. The brazing operation creates an air impervious seal between support ring 22 and first ceramic spacer 28. An upper MCP terminal 32 is joined to the first ceramic spacer, opposite support ring 22. The upper MCP terminal is also joined to the first ceramic spacer in a brazing operation. Consequently, a second brazing ring 34 is interposed between the upper MCP terminal and the first ceramic spacer. The upper MCP terminal extends into vacuum housing 12 where it conductively engages a metal hold down ring 36 and a metal contact ring 38. The metal contact ring engages the conductive upper surface 42 of MCP 16, while the hold down ring retains the MCP within the housing. Consequently, an electrical bias may be applied to upper surface 42 of MCP 16 by applying the electrical bias to the upper MCP terminal on the exterior of the vacuum housing 12.

A second ceramic spacer 46 is positioned below upper MCP terminal 32, isolating upper MCP terminal 32 from lower MCP terminal 48. The second ceramic spacer 46 is brazed to both upper MCP terminal 32 and lower MCP terminal 48, as such a third brazing ring 50 is interposed between the upper MCP terminal 32 and second ceramic spacer 46 and a fourth brazing ring 52 is interposed between second ceramic spacer 46 and lower MCP terminal 48. The lower MCP terminal extends into vacuum housing 12 and engages the lower conductive surface 44 of MCP 16. As such, the lower conductive surface of MCP 16 may be coupled to ground by connecting lower MCP terminal 48 to a ground potential external to vacuum housing 12.

A third ceramic spacer 56 separates lower MCP terminal 48 from getter shield 58. The third ceramic spacer is brazed to both lower MCP terminal 48 and getter shield 58. As such, a fifth brazing ring 60 is interposed between lower MCP terminal 48 and third ceramic spacer 56. Similarly, a sixth brazing ring 62 is interposed between third ceramic spacer 56 and getter shield 58.

A fourth ceramic spacer 64 is positioned below getter shield 58, separating the getter shield from output screen support 66. The fourth ceramic spacer is brazed to both getter shield 58 and output screen support 66. As such, seventh and eighth brazing rings 68 and 70 are positioned above and below fourth ceramic spacer 64, respectively.

The lower end of vacuum housing 12 is sealed by the presence of an output screen flange 72. The output screen flange is joined to both the output screen support 66 and fiber optic element 18. A first seal 74 occurs at a point where output flange 72 is joined to screen support 66. A second first seal 76 occurs at a location where flange 72 joins fiber optic element 18. The combination of the three seals (74, 76, and 22), thus, forms an air tight envelope defined by vacuum housing 12 in between photocathode 14 and fiber optic element 18, whereby vacuum housing 12 is constructed by numerous stacked components joined together to form an air impervious chamber.

Still referring to FIG. 1, the sloped faceplate portion of photocathode 14' positions the cathode in proximity to MCP 16, in order to yield a high resolution image, 10 while at the same time attempting to maintain separation via ceramic spacers 28 and 46 and hold down mechanism (i.e. hold down ring 36, contact ring 38 and MCP support ring 48) to provide a voltage bias to the plate without incurring voltage breakdown, arcing or electrical leakage. As such, if large differences in potential are applied to support ring 22 and upper MCP terminal 32, arcing or other electrical leakage may occur across first ceramic spacer 28 on the exterior of vacuum housing 12. Similarly, if large varied potentials are applied between upper MCP terminal 32 and lower MCP terminal 48, similar arcing or other leakage may occur across second ceramic spacer 46. Such leakage problems are particularly prevalent when using multiple stacked elements across the exterior of vacuum housing 12 in humid environments. Furthermore, as shown, two seals are used in the housing design (reference numerals 74 and 76). Because of the multiple seals, the unit is susceptible to vacuum leakages at either one or both of the seals. In addition, the length of the vacuum housing is extended as evidenced by length 66A of screen support 66 required to seal both output flange 72 and ceramic spacer 64 as well as maintain the tube in its fixture, thus yielding a tube length L of approximately 0.7" long.

The quantity, physical form and position of the ceramic spacers integrated within tube 10 present various challenges. In particular, since the image intensifier tubes are susceptible to electrical breakdown across the ceramic spacers, the size of the spacers need to be large enough to prevent voltage potential breakdown. Conversely, the spacers need to be small enough to accommodate a lightweight and compact tube. Furthermore, the variety of spacers, terminals, and support posts are expensive to manufacture and individually inventory. As a result of the numerous components, the assembly process of the image intensifier tube is laborious, complex and costly. Finally, the accumulated tolerances of the individual pacers, rings and support posts impede consistent assembly of the tube. Therefore, it would be desirable to reduce the number of components, as well as the complexity of the components that are integrated into the image intensifier tube.

Two different image intensifier tubes are presently utilized to accommodate either an inverting fiber optic element or a non-inverting fiber optic element. The fiber optic element depends upon the end-use of the image intensifier tube (i.e. night vision goggle or camera). It would be advantageous to provide a single image intensifier tube that may be configured to accommodate either an inverting fiber optic element or a non-inverting fiber optic element.

The present invention advantageously enhances the overall design of the image intensifier tube by reducing component and inventory costs and improving manufacturability and overall assembly of the image intensifier tube.

SUMMARY OF THE INVENTION

According to an aspect of this invention an image intensifier tube is provided. The image intensifier tube has a microchannel plate (MCP), a photocathode and phosphor screen deposited on a fiber optic substrate. A first spacer is positioned between the microchannel plate and the fiber optic substrate. A second spacer is positioned between the fiber optic substrate and the photocathode. The first and second spacers cooperate to provide a spatial relationship among the MCP, phosphor screen and photocathode for effective operation of the image intensifier tube.

According to another aspect of this invention an image intensifier tube is provided. The image intensifier tube comprises a phosphor screen deposited on top of a fiber optic substrate, a microchannel plate (MCP), disposed above the phosphor screen, having electrical input and output contacts, and conductive vias provided through the fiber optic substrate. The conductive vias provide electrical potential to the input and output contacts of the MCP.

According to yet another aspect of this invention an image intensifier tube having a microchannel plate and a fiber optic is provided. The image intensifier tube includes a single spacer positioned between the microchannel plate and the fiber optic.

According to still another aspect of this invention an image intensifier tube having a microchannel plate and a photocathode is provided. The image intensifier tube includes a single spacer positioned between the microchannel plate and the photocathode.

According to another aspect of this invention a method of assembling an image intensifier tube is provided. The method comprises the steps of positioning a spacer above and in direct contact with a fiber optic screen assembly, wherein the fiber optic screen assembly comprises a phosphor screen deposited on a fiber optic substrate. A microchannel plate is positioned above and in direct contact with the spacer.

According to still another aspect of this invention an image intensifier tube having an electron sensing electronic readout anode positioned adjacent to an MCP is provided. The readout anode includes a silicon imager mounted on a ceramic header, and conductive vias are provided through the ceramic header. The conductive vias provide electrical potential to the input and output contacts of the MCP.

BRIEF DESCRIPTION OF THE DRAWINGS

The invention is best understood from the following detailed description when read in connection with the accompanying drawing. Included in the drawing are the following figures.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

The invention is best understood from the following detailed description when read in connection with the accompanying drawing figures, which shows exemplary embodiments of the invention selected for illustrative purposes. The invention will be illustrated with reference to the figures. Such figures are intended to be illustrative rather than limiting and are included herewith to facilitate the explanation of the present invention.

Figure 2A:
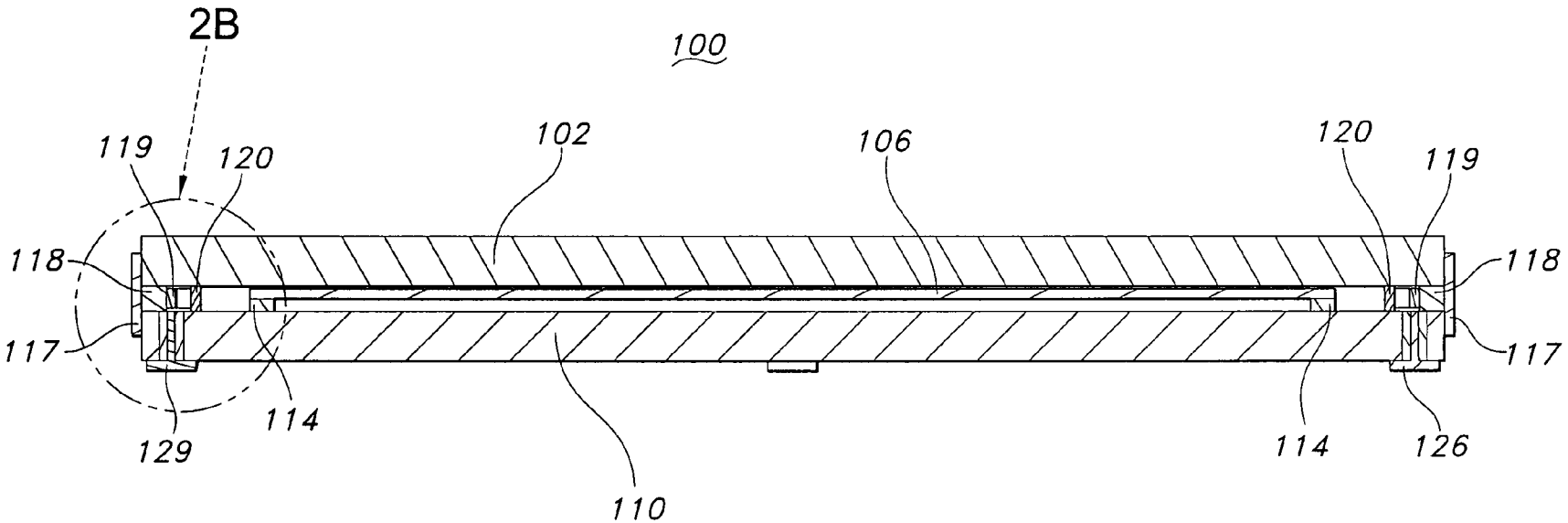
FIG. 2*a* is a cross-sectional side view of an embodiment of an image intensifier tube according to an aspect of this invention.
Figure 2B:
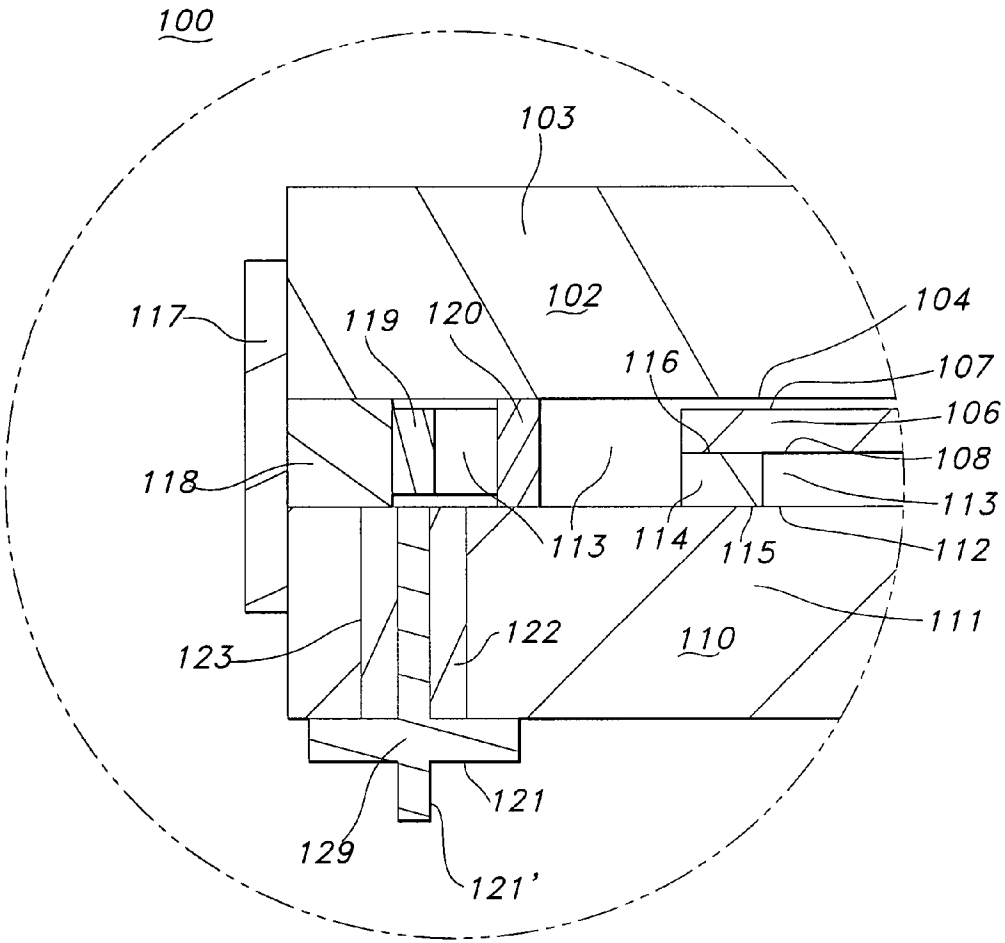
FIG. 2*b* is a detailed view of the embodiment of the image intensifier tube illustrated in FIG. 2*a;*

Referring now to the exemplary embodiments illustrated in FIGS. 2*a* and 2*b*, an image intensifier tube assembly designated by numeral 100 is shown. A detailed cross-sectional side view of image intensifier tube assembly 100 is illustrated in FIG. 2*b*.

As shown, image intensifier tube assembly 100 is of cylindrical form and generally includes three major components, i.e. fiber optic screen assembly 110, microchannel plate (MCP) 106 and photocathode face plate assembly 102. A microchannel plate (MCP) spacer 114 is positioned above fiber optic screen assembly 110. The microchannel plate (MCP) 106 is positioned above MCP spacer 114. A cathode spacer 118 is positioned between fiber optic screen assembly 110 and photocathode face plate assembly 102. A centering ring 117 and getter 119 are coupled to opposing sides of cathode spacer 118. A getter shield 120 is positioned between fiber optic screen assembly 110 and photocathode face plate assembly 102, being radially interior to getter 119. A vacuum condition is sustained within interior chamber 113, disposed between face plate assembly 102 and screen assembly 110.

The fiber optic screen assembly 110 includes fiber optic substrate 111, phosphor screen 112, deposited on the top side of fiber optic substrate 111, and frit seal assemblies (126, 129 shown) extending through the thickness dimension of fiber optic substrate 111. Two frit seal assemblies (126, 129) are illustrated in FIG. 2*a* and a single frit seal assembly (129) is illustrated in FIG. 2*b*. Each frit seal assembly includes frit bead 122 and contact sleeve 121, which is described in further detail later. The phosphor screen is concentrated in an active area of fiber optic substrate 111, which is radially interior to spacer 114.

The photocathode face plate assembly 102 includes input face plate 103 and photocathode 104 deposited onto face plate 103. The photocathode 104 may be thermally bonded onto face plate 103. The central axes of photocathode 104, MCP 106 and phosphor screen 112 may be substantially aligned with respect to one another.

Still referring to FIGS. 2*a* and 2*b*, fiber optic substrate 111 accommodates the frit seal assemblies, which provide electrical contact to MCP 106, getter 119 and phosphor screen 112. The phosphor screen 112, which is deposited on the top surface of fiber optic substrate 111, may be a thin film deposited by evaporation, sputtering or brushing. The surface area utilized by phosphor screen 112 is called the active area of fiber optic screen assembly 110. The fiber optic substrate 111 may be optionally made of a non-conductive material, such as glass or ceramic. The general shape of input faceplate 103 may be cylindrical for mounting into a night vision goggle, camera or other night vision apparatus. Although it should be understood that the shape of input faceplate 103 as well as the entire tube assembly 100 may be square, rectangular, hexagonal, or any other shape.

Figure 3B:
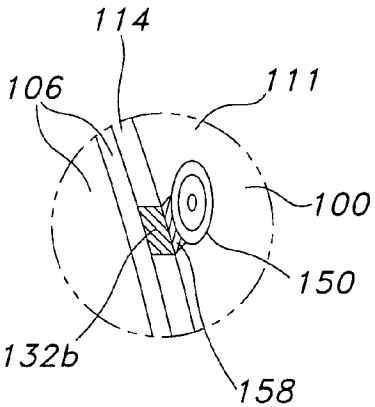
FIG. 3*b* is a detailed view of the embodiment of the subassembly illustrated in FIG. 3*a;*
Figure 3A:
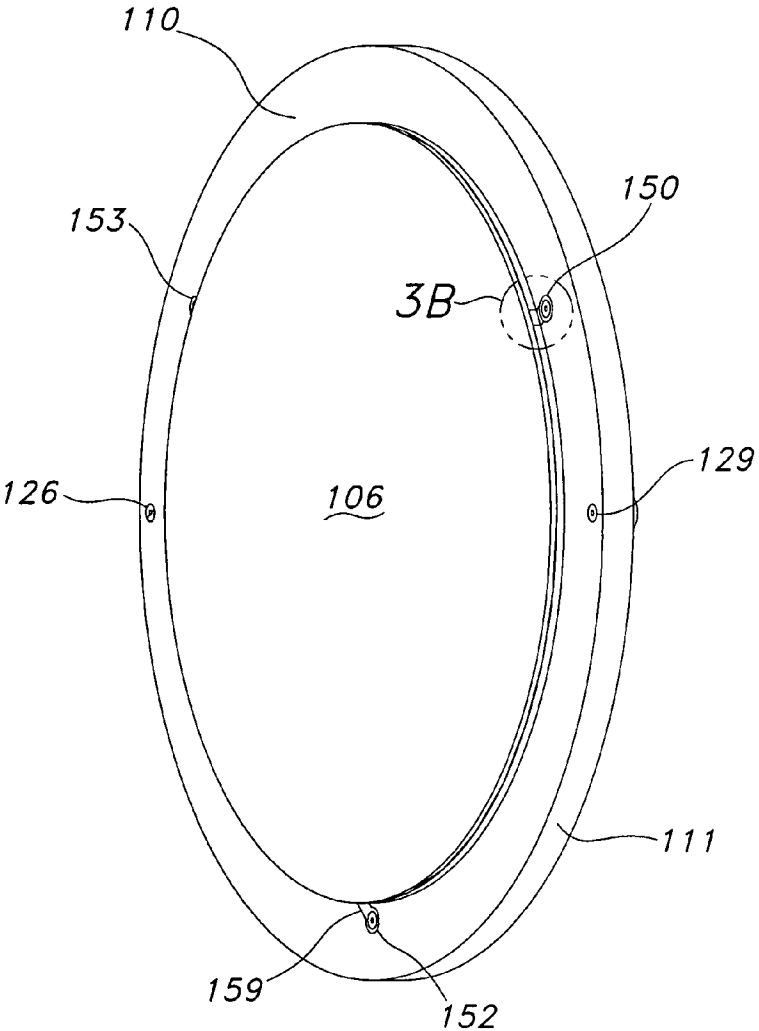
FIG. 3*a* is a perspective view of the fiber optic screen assembly, microchannel plate spacer and microchannel plate illustrated in FIG. 2*a;*

Several vacuum-compatible frit seal assemblies are extended through the thickness dimension of fiber optic substrate 111. Five frit seal assemblies are positioned about the circumference of fiber optic substrate 111, as illustrated in FIGS. 3*a*, 3*b* and 4. A cross-section of a frit seal assembly including frit bead 122 and contact sleeve 121 is illustrated in FIG. 2*b*. The frit seal assemblies are inserted thru apertures formed about fiber optic substrate 111. The frit beads 122 are composed of a vacuum-compatible material that hermetically seals the apertures within fiber optic substrate 111.

The present invention advantageously uses each frit seal assembly to provide a way to apply discrete voltages to the interior components of tube assembly 100 from the exterior of tube assembly 100, without compromising the vacuum within interior chamber 113. The frit seal assemblies are isolated from one another as they are distributed about fiber optic substrate 111, as best shown in FIG. 4, to limit electrical arcing or shorting from one frit seal assembly to another.

In assembly, frit beads 122 and contact sleeves 121 (FIG. 2*b*) are positioned in apertures of fiber optic substrate 111. One aperture is shown in FIG. 2*b* generally designated as 123. The fiber optic substrate, along with contact sleeves 121 and frit beads 122 assembled therein, are heated to a predetermined temperature for a predetermined time duration. The frit bead 122 melts around contact sleeve 121 to form a hermetic seal within aperture 123. The frit assembly 129 selected for illustration in FIG. 2B is male, by virtue of the male protrusion 121'. In use, a current carrying female pin (not shown) is inserted onto male protrusion 121' to conduct current from male contact sleeve 121 to a contact disposed on the opposing side of fiber optic substrate 111. Although a male protrusion 121' is selected for illustration, a female contact may be alternatively used.

The input faceplate 103 provides a mounting surface for photocathode 104. The input faceplate may be formed of a non-conductive material, such as, glass or ceramic. Similar to fiber optic substrate 111, the general shape of input faceplate 103 may be cylindrical.

Figure 5B:
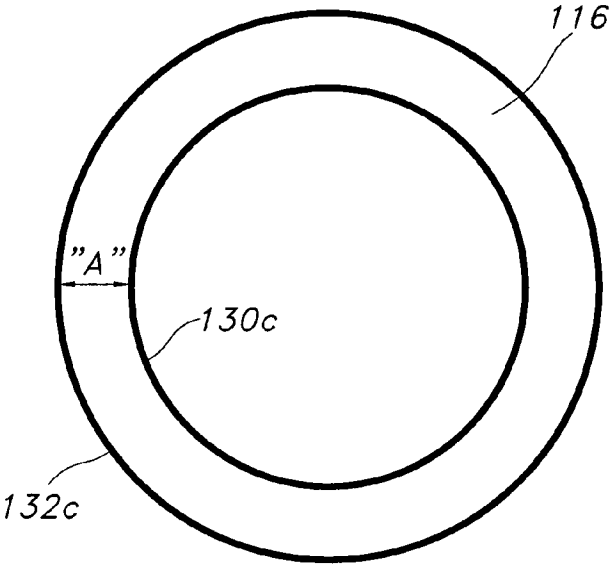
FIG. 5*b* is a top-side view of the microchannel plate spacer illustrated in FIG. 5*a;*

As best seen in FIG. 2*b*, MCP spacer 114 performs a variety of functions. The MCP spacer (1) separates MCP 106 and screen assembly 110, (2) conducts two different electrical potentials to MCP 106 and (3) insulates MCP 106 from phosphor screen 112. Together with cathode spacer 118, the thickness tolerance of MCP spacer 114 effectively controls the distance between MCP 106 and photocathode 104 thereby limiting halo (described in further detail later). The MCP spacer 114 may be a non-conductive, flat cylindrical ring composed of ceramic or any other non-conductive material, such as glass. Two electrically conductive regions (best illustrated in FIG. 5*b*) deposited onto the exterior surface of spacer 114 provide electrical connections from the frit seal contacts to the top and bottom sides of MCP 106. Other than the two conductive regions, spacer 114 insulates MCP 106 from phosphor screen 112 and the other electrical contacts deposited on fiber optic substrate 111.

The MCP spacer 114 may be fixed to both MCP 106 and screen assembly 110 with either an epoxy or solder. A variety of epoxies or solders may be used to fix the components. It is contemplated that the epoxy may be a high temperature vacuum compatible epoxy. If a solder is utilized, the solder may be a low temperature solder capable of bonding at low pressure and reflow in a vacuum bake. Non-limiting examples of solder materials are indium thin film or gold/tin thin film. The solder may be in the form of a decal (0.0005" thick, for example). A decal is advantageous from an assembly perspective, because the thickness tolerance of a decal is minimal (for example, about 0.0001"), thereby providing a relatively consistent assembly process. Furthermore, the flat shape of spacer 114 together with a flat decal further enhances the assembly process.

The cathode spacer 118 is sandwiched between and completely separates screen assembly 110 and face plate assembly 102. Together with MCP spacer 114, the thickness tolerance of cathode spacer 118 effectively controls the distance between MCP 106 and photocathode 104. Optionally formed from a single flat cylindrical ring, cathode spacer 118 may be formed from any conductive or non-conductive material, such as, copper, glass or aluminum. Moreover, since fiber optic substrate 111 may be formed from a non-conductive material, cathode spacer 118 may be formed from a conductive material without concern of shorting out the electrical potentials of phosphor screen 112 and photocathode 104. The cathode spacer may (or may not) extend continuously around the circumference of tube assembly 100. The cathode spacer is optionally coupled to both fiber optic substrate 111 and input faceplate 103 using an epoxy, solder, weld or any other attachment known in the art.

The centering ring 117 illustrated in FIG. 2*b* circumferentially surrounds tube assembly 100 and abuts fiber optic substrate 111 and input faceplate 103 and optionally abuts cathode spacer 118. The centering ring 117 shown in FIGS. 2*a* and 2*b* extends continuously around the circumference of tube assembly 100. In addition to providing structural support, centering ring 117 may provide a conductive path to photocathode 104. The interfaces between centering ring 117, fiber optic substrate 111 and input faceplate 103 are desirably air tight to maintain a vacuum condition throughout interior chamber 113. An indium seal or low temperature braze may optionally join the aforementioned interfaces. By way of a non-limiting example, an indium seal may be, for example, a 0.002" thick indium decal that is adhered via a low pressure application. A hot seal may also be used by heating the indium seal with RF energy.

Alternatively, the interface between centering ring 117 and cathode spacer 118 does not have to be vacuum tight. Accordingly, centering ring 117 may be joined to cathode spacer 118 via any mechanical fastening means, such as press-fitting. The centering ring may also be coupled to cathode spacer 118 via epoxy, braze or indium film. Although cathode spacer 118 and centering ring 117 are illustrated as separate components in FIG. 2*b*, they may be integrally formed from a single component to further reduce the number of tube assembly components.

As described previously, a vacuum condition exists within interior chamber 113 of tube assembly 100. The vacuum facilitates the migration of electrons from photocathode 104 to MCP 106 and then to phosphor screen 112. Although tube assembly 100 is sealed, gas molecules may form within interior chamber 113 over the lifetime of the tube assembly. A getter 119 maintains the vacuum condition by collecting gas molecules within interior chamber 113. The use of getter materials is based on the ability of certain solids to collect free gases by adsorption, absorption or occlusion, as is well known in the art.

The getter optionally takes the form of a cylindrical ring extending around a circumference, as illustrated in FIGS. 2*a* and 2*b*. Although getter 119 is illustrated as a single component, getter 119 may be formed from two or more components and may, optionally, extend around a portion of the circumference. Furthermore, getter 119 is not limited to a cylindrical ring and may also be a wire or other structure. Getter 119 may be positioned between screen assembly 110 and face plate assembly 102 and may be fixed to cathode spacer 118 via a weld, braze or epoxy. As illustrated in FIG. 2*b*, a gap optionally exists above and below getter 119. The illustrated gaps are not critical to the operation of getter 119.

It will be appreciated that an image intensifier tube assembly may include either an evaporable or non-evaporable type getter. In this exemplary embodiment, evaporable getter 119 and corresponding getter shield 120 are selected for illustration. Over the course of operation, the evaporable getter material evaporates and collects on the surface of getter shield 120. If a non-evaporable getter is selected, a getter shield may not be required.

The getter shield is a cylindrical ring, optionally, extending around a circumference and positioned radially interior to getter 119. Although getter shield 120 is illustrated as a cylindrical ring, getter shield 120 is not limited to such shape or form. The getter shield may be formed of any vacuum compatible and structurally stable material. A weld, epoxy or thin film may be applied at the interface of getter shield 120 and fiber optic substrate 111 to temporarily or permanently couple the two components.

Figure 1:
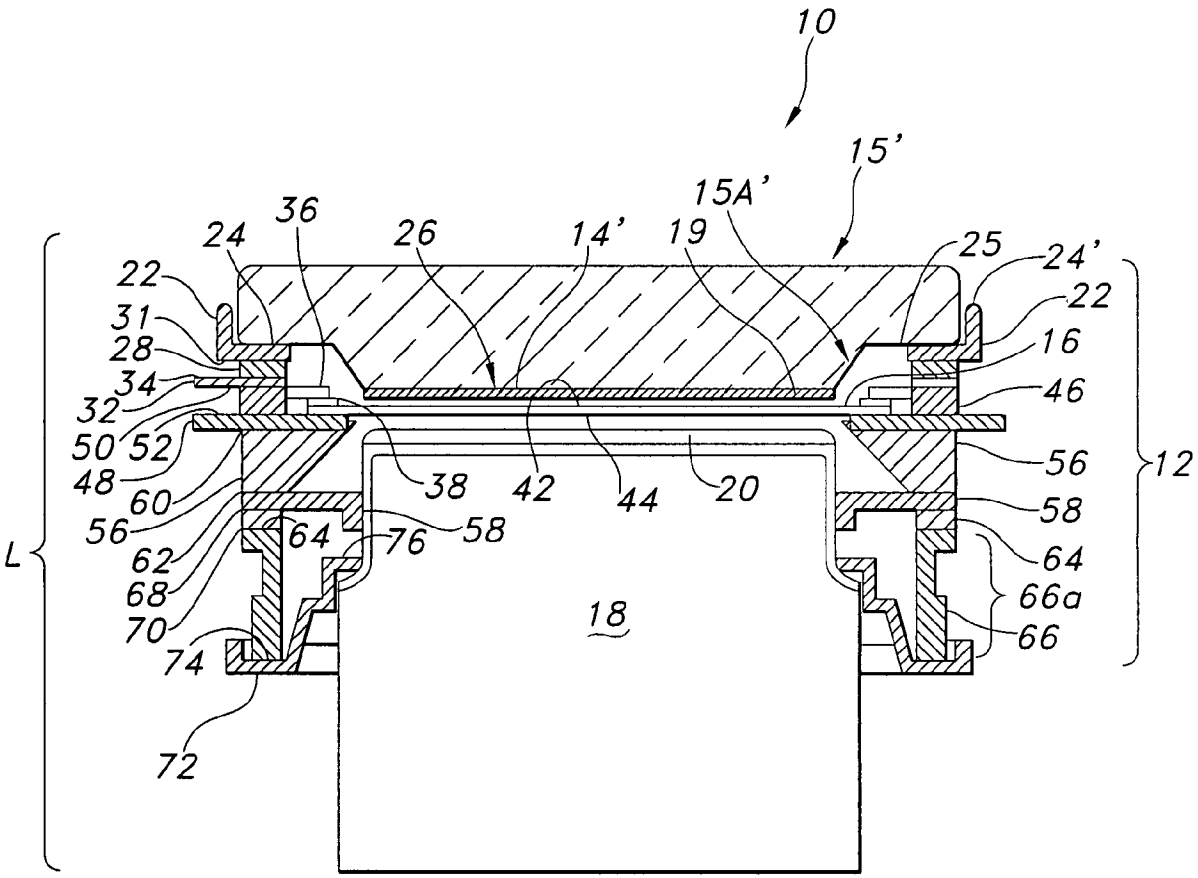
FIG. 1 (PRIOR ART)
FIG. 1 is a cross-sectional side view of a prior art image intensifier tube.

Halo is a factor limiting the performance of image intensification tubes and is dependent upon the distance separating the photocathode and MCP. The tolerance of a desirable distance between the photocathode and MCP may be on the order of several microns. In order to limit or minimize halo, the distance between the MCP and the photocathode must be precise. The prior art example, illustrated in FIG. 1, includes at least six spacers, terminals and plates positioned between the MCP and photocathode and the thickness of each has a corresponding tolerance. Thus, in the illustrated example, it is very difficult to control the tolerance of all six components in order to control the distance between the photocathode and the MCP.

In the exemplary embodiment illustrated in FIGS. 2*a* and 2*b*, however, only two flat spacers separate MCP 114 and photocathode 104. Specifically, cathode spacer 118 separates screen assembly 110 and photocathode 104 and MCP spacer 114 separates MCP 106 and screen assembly 110. Therefore, only cathode spacer 118 and MCP spacer 114 define the gap between MCP 106 and photocathode 104. Although not illustrated, solder, thin film, or epoxy layers fixing MCP spacer 114 to MCP 106 and screen assembly 110 also affects the gap tolerance between MCP 106 and photocathode 104. Additionally, solder, thin film or epoxy layers fixing cathode spacer 118 to face plate assembly 102 and screen assembly 110 also affects the gap tolerance between MCP 106 and photocathode 104. However, the thickness and associated tolerance of the solder, thin film, decal or epoxy layer is minimal. Moreover, flat surface and few components further facilitates precise tolerance and inexpensive assembly of tube assembly 100.

The photocathode 104, MCP 106, phosphor screen 112 and getter 119 are each separately connected to an electrical power source (not shown). Each of these components operates at a different voltage potential. In particular, phosphor screen 112 is maintained at a higher positive potential than photocathode 104. MCP 106 is maintained at a higher positive potential than photocathode 104 and a lower positive potential than phosphor screen 112. Accordingly, the conductive paths directing electrical voltage to each component are isolated from one another to inhibit electrical shorting of the conductive paths.

Referring now to FIGS. 3*a* and 3*b*, MCP 106, MCP spacer 114 and fiber optic screen assembly 110 are illustrated. The fiber optic screen assembly includes fiber optic substrate 111 and several frit seal assemblies, i.e. MCP electrical input contact 150, MCP electrical output contact 152, first getter electrical contact 126, second getter electrical contact 129 and phosphor screen contact 153. Each frit seal assembly includes contact sleeve 121 and frit bead 122 (FIG. 2*b*) extending through the thickness dimension of fiber optic substrate 111. Each frit seal assembly conducts electricity to a different electrical contact point. More particularly, MCP input contact 150 conducts electricity to an input side of MCP 106, MCP output contact 152 conducts electricity to an output side of MCP 106, getter contacts 126 and 129 conduct electricity to getter 119 and phosphor screen contact 153 conducts electricity to phosphor screen 112. The frit seal assemblies are positioned sufficiently to inhibit electrical shorting between the different voltages, or potentials.

Figure 4A:
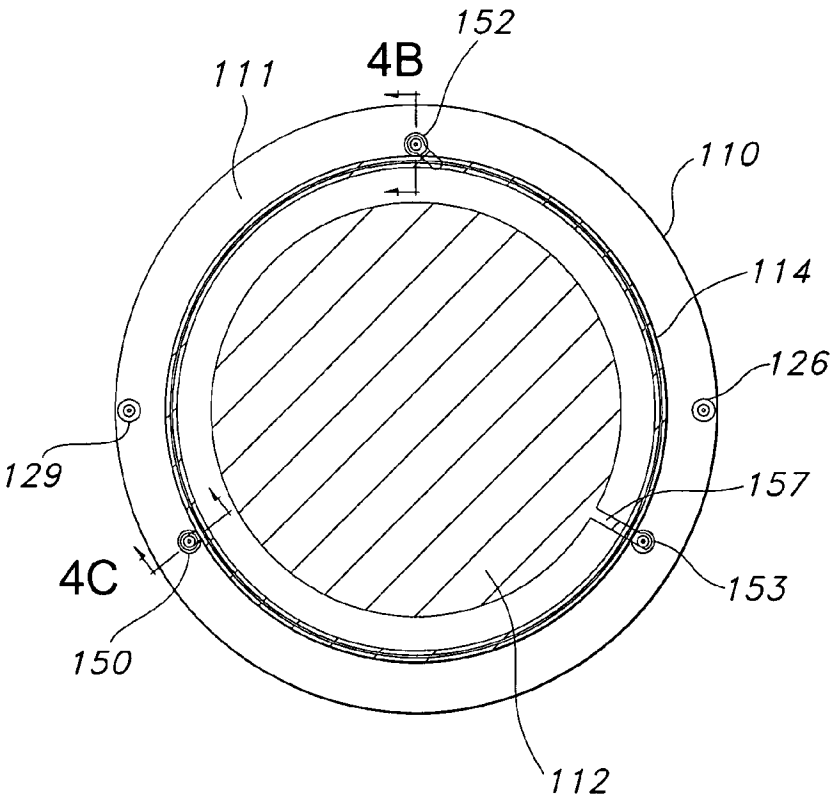
FIG. 4*a* is a top-side view of the fiber optic screen assembly and microchannel plate spacer illustrated in FIG. 2*a;*
Figure 4C:
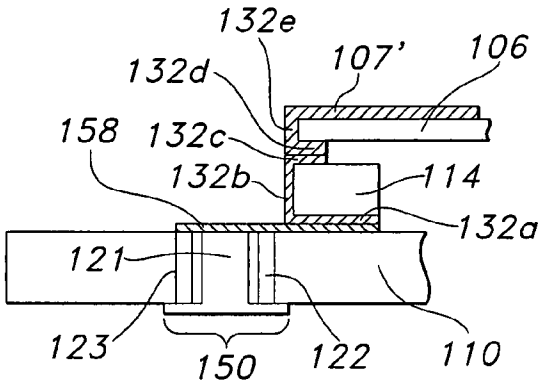
FIG. 4*c* is another detailed view of the fiber optic screen assembly and microchannel plate spacer illustrated in FIG. 4*a* and a microchannel plate not shown in FIG. 4*a;*
Figure 4B:
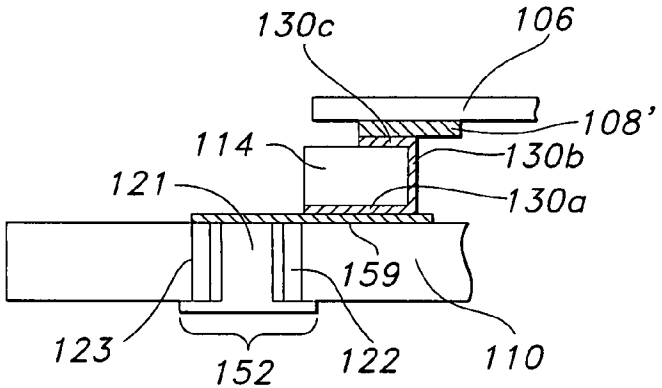
FIG. 4*b* is a detailed view of the fiber optic screen assembly and microchannel plate spacer illustrated in FIG. 4*a* and a microchannel plate not shown in FIG. 4*a;*

Referring now to FIG. 4*a*, fiber optic screen assembly 110 and MCP spacer 114 are illustrated. As shown, MCP spacer 114 rests directly above conductive strip 157. Since MCP spacer 114 is insulative, it is electrically isolated from conductive strip 157. The phosphor screen 112 is deposited on the top surface of fiber optic substrate 111, by an evaporation, plating, or similar process. A thin conductive strip 157, also deposited or plated on the top surface of fiber optic substrate 111, extends from phosphor screen 112 to phosphor screen electrical contact 153. The phosphor screen conductive path extends from phosphor screen contact 153, along conductive strip 157 to phosphor screen 112. In operation, a current carrying female contact (not shown) is electrically connected to phosphor screen contact 153 to provide power to phosphor screen 112.

Referring back to FIGS. 3*a* and 3*b*, two short conductive strips 158 and 159 are shown deposited or plated onto the top surface of fiber optic substrate 111 to conductively engage MCP electrical input contact 150 and MCP electrical output contact 152, respectively. In assembly, conductive strips 158 and 159 may be aligned with conductive regions on MCP spacer 114, as will be described later.

Tube assembly 100, shown in FIG. 2*b*, requires two electrical connections for MCP 106. Specifically top input side 107 and bottom output side 108 of MCP 106 are maintained at different voltage potentials. The present invention uses MCP spacer 114 to define two discrete conductive paths to both the input and output sides of MCP 106. As shown in FIGS. 4*a*-4*c*, 5*a*-5*d* and 6*a*-6*c*, MCP input path 132 and MCP output path 130 are patterned on the exterior surfaces of both MCP spacer 114 and MCP 106 to conduct current from MCP input contact 150 (FIG. 4*a*) and MCP output contact 152 (FIG. 4*a*) to the top and bottom sides of MCP 106, respectively. The conductive paths 130 and 132 may optionally be deposited, evaporated, sputtered, or plated onto spacer 114 and MCP 106.

The MCP input path 132 includes multiple conductive regions, i.e. conductive regions 132*a* through 132*e*. Conductive regions 132*a* through 132*c* are deposited on the exterior surfaces of MCP spacer 114 and conductive regions 132*d* and 132*e* are deposited on the exterior surfaces of MCP 106. More specifically, conductive region 132*a* is deposited onto the bottom side 115 of MCP spacer 114 and is in contact with conductive strip 158 deposited on fiber optic substrate 111. Conductive region 132*b* extends vertically along a portion of the outer surface of MCP spacer 114 and is connected to conductive region 132*a* on the bottom side 115 of MCP spacer 114. Conductive region 132*c* is deposited in an annular shape onto the top side 116 of MCP spacer 114 and is connected to conductive region 132*b*. The conductive region 132*c* reaches the outer diameter of spacer 114 and optionally extends around the total circumference of spacer 114. The size of the region 132*c* may be any dimension sufficient to distribute current.

The top side 116 of MCP spacer 114 is in contact with bottom side 108 of MCP 106. Moreover, a conductive region 132*d* deposited onto the bottom side 108 of MCP 106 is substantially aligned with and connected to conductive region 132*c* deposited on the topside 116 of MCP spacer 114. The conductive region 132*d* optionally extends around the total circumference of MCP 106. Conductive region 132*d* is substantially the same size as the annular conductive region 132*c* deposited on MCP spacer 114. Conductive region 132*e* extends vertically along a portion of the outer surface of MCP 106 and is connected to conductive region 132*d*. Although not illustrated, conductive region 132*e* may extend along the entire circumference of MCP 106. The conductive region 107' on top input side 107 of MCP 106 is connected to conductive region 132*e*. Conductive region 107' is a metallic surface that maintains top input side 107 of MCP 106 at a predetermined voltage.

A portion of MCP input path 132 is illustrated in FIG. 3*b* for the purpose of clarity. The conductive strip 158 extending from MCP input contact 150 is connected to conductive region 132*a* (not shown in FIG. 3*b*) which is connected to conductive region 132*b* extending along a portion of the outer surface of MCP spacer 114. Although not illustrated in the figures, conductive region 132*b* may be optionally aligned with conductive region 132*e*.

Similar to MCP input path 132, the MCP output path 130 includes multiple conductive regions, i.e. conductive regions 130*a* through 130*c*, which are deposited on the exterior surface of MCP spacer 114. More specifically, conductive region 130*a* is deposited onto the bottom side 115 of MCP spacer 114 and is in contact with conductive strip 159. Conductive region 130*a* is sufficiently separated from conductive region 132*a*, to avoid electrically shorting the two regions. The size, shape and location of conductive region 130*a*, as well as conductive region 132*a*, are not limited to the embodiment selected for illustration.

Figure 5C:
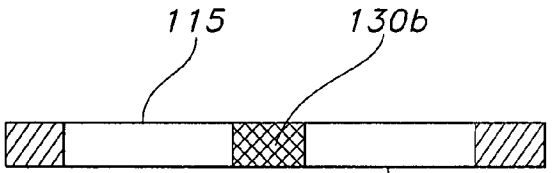
FIG. 5*c* is a cross-sectional side view of the microchannel plate spacer illustrated in FIG. 5*a;*
Figure 5A:
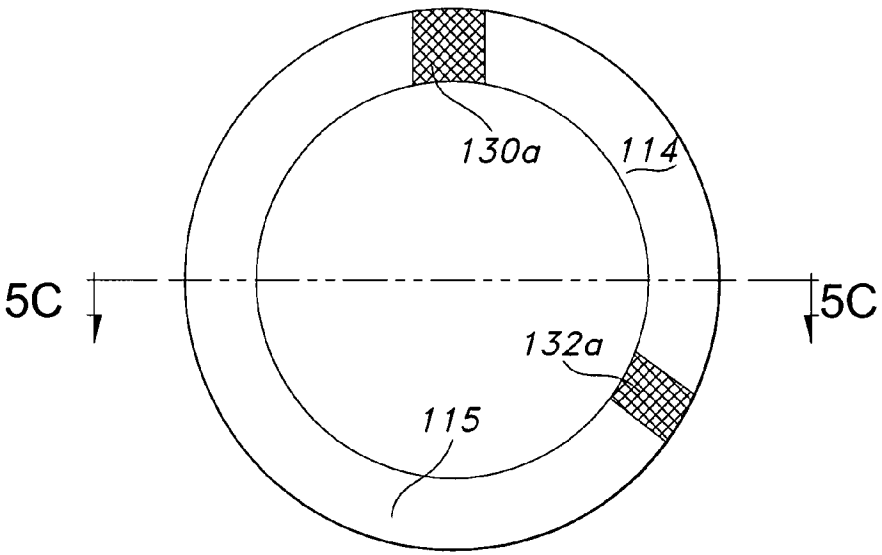
FIG. 5*a* is a bottom-side view of an embodiment of the microchannel plate spacer illustrated in FIG. 2*a;*
Figure 5D:
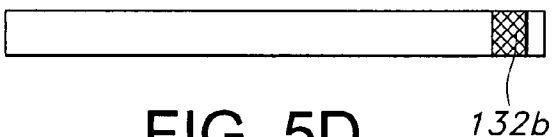
FIG. 5*d* is a side view of the microchannel plate spacer illustrated in FIG. 5*a;*
Figure 6C:
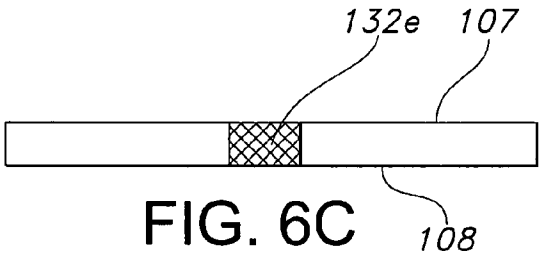
FIG. 6*c* is a side view of the microchannel plate illustrated in FIG. 6*a;*
Figure 6A:
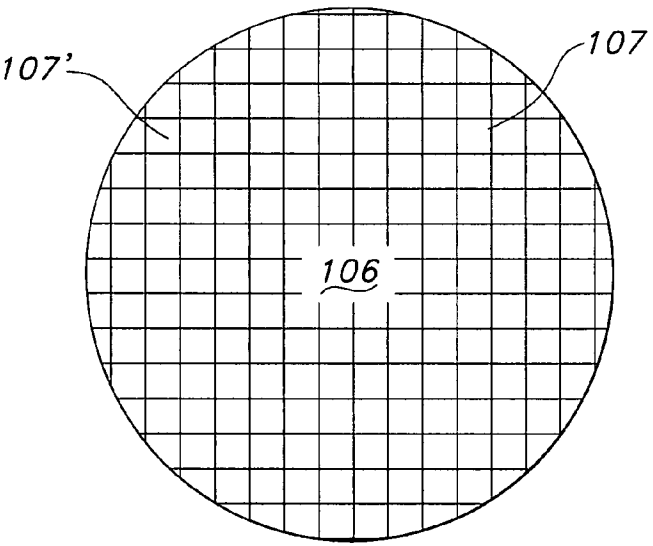
FIG. 6*a* is a top-side view of an embodiment of the microchannel plate illustrated in FIG. 2*a;*
Figure 6B:
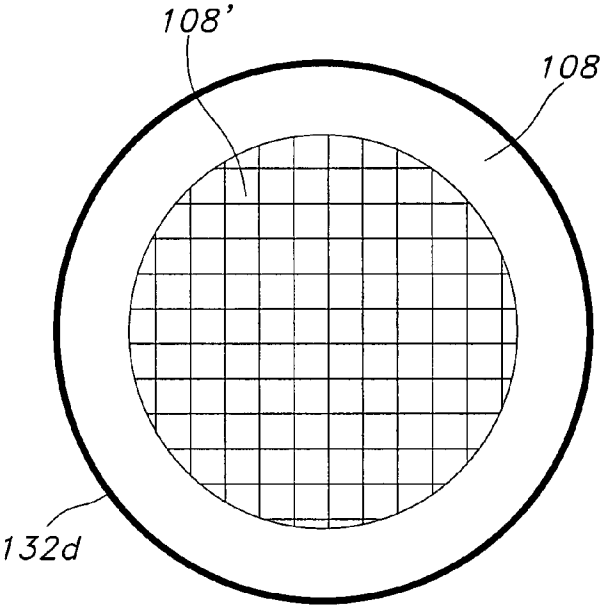
FIG. 6*b* is a bottom-side view of the microchannel plate illustrated in FIG. 6*a;*

Conductive region 130*b* extends vertically along the interior cylindrical surface of MCP spacer 114 and is connected to conductive region 130*a*. Although conductive region 130*b* extends along a portion of the circumference, as shown in FIG. 5C, conductive region 130*b* may extend vertically along the entire circumference of MCP spacer 114. Annular conductive region 130*c* is positioned on the top side 116 of MCP spacer 114, radially interior to conductive region 132*c* and extends to the interior cylindrical surface of MCP spacer 114. Conductive region 130*c* is connected to conductive region 130*b*. The conductive regions 130*c* and 132*c* are separated by an annular gap "A", which may be any dimension sufficient to inhibit electrically shorting conductive regions 130*c* and 132*c*. Although not illustrated, the conductive regions 130*c* and 132*c* may be rectangular shaped (similar to regions 130*a* and 132*a*), and are not limited to the annular shape as shown.

The conductive region 108' patterned on bottom output side 108 of MCP 106 is connected to conductive region 130*c* which is positioned on top side 116 of MCP spacer 114. The centers of both conductive region 108' and conductive region 130*c* are substantially aligned to ensure conductive contact between the regions. Conductive region 108' is a metallic surface that maintains bottom output side 108 of MCP 106 at a predetermined voltage. The conductive region 108' and 132*d* are separated by an annular gap "B", which may be any dimension sufficient to inhibit electrically shorting conductive regions 108' and 132*d*.

In brief review, a current carrying wire, male pin or female contact extending from a power supply (not shown) is connected to MCP electrical input contact 150. The current is conducted through MCP electrical input contact 150 to conductive strip 158. Conductive strip 158 is in contact with conductive regions 132*a* through 132*c* deposited on the exterior surface of MCP spacer 114. The current is thereafter conducted through conductive regions 132*d* and 132*e* deposited on the exterior surface of MCP 106. The conductive region 132*e* is connected to conductive region 107', which maintains top input side 107 of MCP 106 at a predetermined voltage.

Moreover, a current carrying wire, male pin or female contact extending from a power supply is connected to MCP electrical output contact 152. The current is conducted through MCP electrical output contact 152 to conductive strip 159. Conductive strip 159 is linked to conductive regions 130*a* through 130*c* deposited on the exterior surface of MCP spacer 114. The current is thereafter conducted to conductive region 108', which maintains bottom output side 108 of MCP 106 at a predetermined voltage. The bottom output side 108 of MCP 106 may be maintained at a higher or lower voltage potential than top input side 107 of MCP 106.

Referring now to FIGS. 2*b* and 4*a*, tube assembly 100 of this exemplary embodiment includes two electrical connections for getter 119. Briefly, the power source (not shown) is coupled (via wire or pin, for example) to getter contacts 126 and 129. Although not shown, in this exemplary embodiment two wires extend between and are conductively connected to getter contacts 126 and 129 and getter 119. However, other ways exist to activate the getter as this invention is not limited to the described conduction path.

Referring now to FIG. 2*b*, tube assembly 100 of this exemplary embodiment comprises one electrical connection for photocathode 104. Briefly, the power source (not shown) is coupled to centering ring 117 (via wire or pin, for example) which is conductively coupled to photocathode 104. Several ways exist to establish a conductive path from centering ring 117 to photocathode 104. For example, centering ring 117 may merely contact photocathode 104 via press-fitting, indium seal, braze, solder, or weld, for example. Alternatively, if cathode spacer 118 is composed of a conductive material, centering ring 117 may be conductively coupled to cathode spacer 118 which may be conductively coupled to photocathode 104, thereby establishing a conductive path. Furthermore, a metallic contact region may be deposited onto the cylindrical surface of photocathode 104 that is in physical contact with centering ring 117.

With regards to the assembly of tube assembly 100 of this exemplary embodiment, the phosphor screen 112 is evaporated, plated or bonded on the top surface of fiber optic substrate 111. The frit seal assemblies are inserted through apertures 123 positioned in fiber optic substrate 111. The frit seal assemblies are heated until the glass frit melts and forms an optionally hermetic vacuum-tight seal. The MCP spacer 114 is oriented above fiber optic substrate 111 so that conductive regions 132*a* and 130*a* align with and conductively engage with conductive strips 158 and 159, respectively. A conductive epoxy, weld, solder or thin film, for example, may be employed to fix MCP spacer 114 to fiber optic substrate 111. The MCP 106 is oriented above MCP spacer 114 so that conductive regions 132*d* and 108' physically contact and conductively engage with conductive regions 132*c* and 130*c*, respectively, of MCP spacer 114. A conductive epoxy, weld, solder, or thin film for example may be employed to adhere MCP 106 to MCP spacer 114. The cathode spacer 118 may be coupled to fiber optic substrate 111 via a brazing, welding or application of conductive epoxy, for example. Getter 119 is positioned adjacent cathode spacer 118 and optionally coupled to cathode spacer 118 via a brazing, welding or application of conductive epoxy, for example. If getter 119 is of the evaporable type (as illustrated in FIGS. 2*a* and 2*b*), getter shield 120 may be included with tube assembly 100 and positioned adjacent getter 119.

The input faceplate 103 is positioned above cathode spacer 118. The centering ring 117 is coupled to fiber optic substrate 111 and input faceplate 103. The centering ring 117 is optionally coupled to cathode spacer 118. An indium seal (optionally an indium decal) may be positioned at the mating interface of centering ring 117 and fiber optic substrate 111 and the mating interface of centering ring 117 and input faceplate 103. A minimal amount of pressure is applied to the indium seals and the entire assembly is thereafter reflowed in a vacuum bake to form a hermetic seal at the aforementioned mating interfaces.

Although assembly steps are described herein, the assembly process is not limited to the steps or step order as described. Rather, the assembly order and assembly components may vary widely from the above description.

Figure 7:
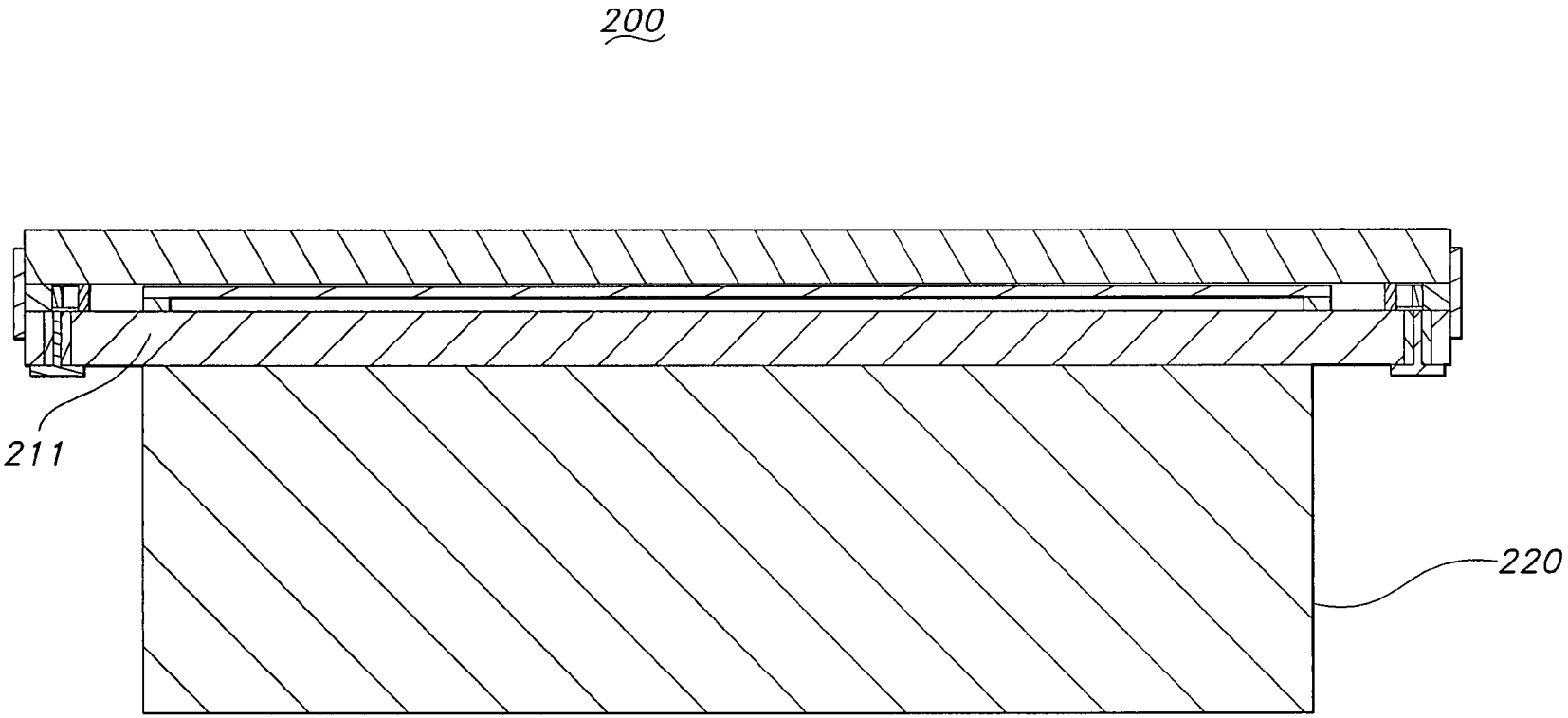
FIG. 7 is a cross-sectional side view of another embodiment of an image intensifier tube including a fiber optic inverter according to an aspect of this invention.

Referring now to FIG. 7, another exemplary embodiment of an image intensifier tube assembly 200 is illustrated. The tube assembly 200 is similar to tube assembly 100, however, tube assembly 200 includes a fiber optic inverter 220. The fiber optic inverter 200 is configured to invert an image. Since an objective lens (not shown) of a night vision system commonly inverts the primary image, fiber optic inverter 220 is utilized to rotate the image right side up for viewing through an eyepiece (also not shown). The fiber optic inverter 220 may be coupled to tube assembly with an optical cement. Although a fiber optic inverter is selected for illustration, a non-inverting fiber optic may also be coupled to tube assembly 200. By virtue of the mechanical design of fiber optic substrate 211, the tube assembly 200 accommodates either an inverting or non-inverting fiber optic. In many instances, the current tube assemblies require separate and unique tube assemblies to accommodate either an inverting or non-inverting fiber optic. It is advantageous to provide a single tube assembly capable of accommodating either an inverting or non-inverting fiber optic from an assembly, cost and inventory standpoint.

Figure 8:
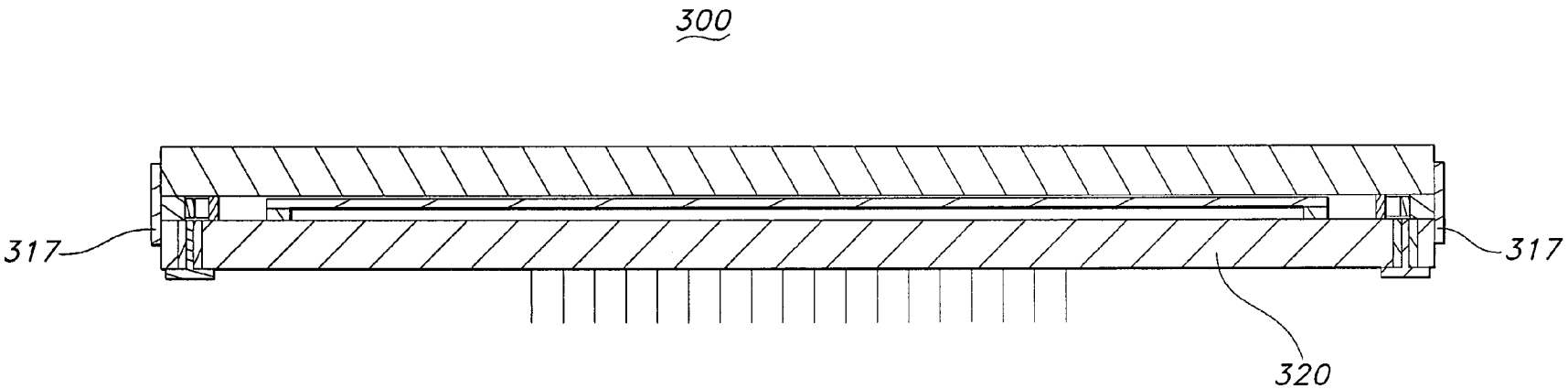
FIG. 8 is a cross-sectional side view of another embodiment of an image intensifier tube according to an aspect of this invention.

Referring now to FIG. 8, another exemplary embodiment of an image intensifier tube assembly 300 is illustrated. The tube assembly 300 is similar to tube assembly 100, as it incorporates the spacers, frit seal assemblies, getter, getter contact, etc. However, tube assembly 300 integrates silicon imager assembly 320 in lieu of the previously described fiber optic screen assembly. The silicon imager assembly 320 is also known as a electron sensing electronic readout anode. The silicon imager assembly 320 may be a complementary metal oxide semiconductor (CMOS) and ceramic header or a charged coupled device (CCD) and ceramic header. Another advantage of the image intensifier tube assembly embodiments is that multiple styles of imaging systems or "tubes" may be integrated with tube assemblies 100, 200, 300.

The top surface of the ceramic header of silicon imager assembly 320 may be substantially planar. For the purposes of comparison, the top surface of various prior art silicon imager assembly embodiments include a protruding rib segment for electro-optic focusing purposes. Accordingly, the exclusion of a protruding rib segment in this exemplary embodiment and more particularly, the reduction of a manufacturing step to create the protruding rib segment, may represent a cost savings. Alternatively, the ceramic header of the silicon imager assembly may be non-planar to incorporate the cathode spacer and the MCP spacer.

The steps to assemble tube assembly 300 are similar to the assembly process associated with tube assembly 100, with the exception of assembling silicon imager assembly 320. A portion of the exterior circumference of silicon imager assembly 320 may be coupled to centering ring 317 with an indium seal, braze, weld, solder, epoxy, or any other fastening method known in the art. The interface between silicon imager assembly 320 and centering ring 317 may be hermetically sealed to maintain a vacuum within tube assembly 300.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention. Also, the embodiments selected for illustration in the figures are not shown to scale and are not limited to the proportions shown. Although attachment means have been described herein, it will be understood that any attachment means known in the art may be utilized.

What is claimed:

1. An image intensifier tube comprising:

a microchannel plate;

a photocathode assembly including a photocathode disposed on a substrate;

a fiber optic substrate defining a planar surface;

a phosphor screen deposited on the planar surface of the fiber optic substrate;

a first spacer positioned in direct contact with both said microchannel plate and said planar surface of said fiber optic substrate; and a second spacer positioned in direct contact with both said photocathode assembly and said planar surface of said fiber optic substrate, wherein said first and second spacers cooperate to provide a spatial relationship among the MCP, phosphor screen and photocathode assembly for effective operation of the image intensifier tube.

2. The image intensifier tube of claim 1 further comprising a getter positioned between the fiber optic substrate and the photocathode assembly.

3. The image intensifier tube of claim 2, wherein said getter is an evaporable getter configured to maintain a vacuum within an interior cavity of the image intensifier tube.

4. The image intensifier tube of claim 2, wherein said getter is a non-evaporable getter configured to maintain a vacuum within an interior cavity of the image intensifier tube.

5. The image intensifier tube of claim 2, wherein said getter comprises a substantially flat cylindrical ring.

6. The image intensifier tube of claim 2 further comprising a getter shield positioned adjacent to said getter and between the fiber optic substrate and the photocathode assembly.

7. The image intensifier tube of claim 1 wherein said first spacer is fixed to the microchannel plate and the fiber optic substrate with a conductive epoxy.

8. The image intensifier tube of claim 1 wherein said first spacer is fixed to the microchannel plate and the fiber optic substrate by a soldering process.

9. The image intensifier tube of claim 1 further comprising a plurality of conductive vias provided through said fiber optic substrate and extending to said planar surface of said fiber optic substrate;

at least one conductive via extending to said planar surface of said fiber optic substrate for providing electrical potential to said phosphor screen.

10. The image intensifier tube of claim 9, said first spacer defining two conductive regions, wherein each conductive region of said first spacer is positioned in contact with a conductive via extending to said planar surface of said fiber optic substrate.

11. The image intensifier tube of claim 10, said MCP having a first conductive region positioned in contact with one of the conductive regions of said first spacer and a second conductive region positioned in contact with the other conductive region of said first spacer for providing electrical potential to said MCP.

12. The image intensifier tube of claim 11, wherein each conductive region of said first spacer extends from a bottom surface of said first spacer to a top surface of said first spacer.

13. The image intensifier tube of claim 12, wherein said first spacer is a substantially flat cylindrical ring comprising said top surface, said bottom surface and two annular side surfaces extending between said top surface and said bottom surface of said first spacer, wherein each conductive region includes a conductive portion defined on said bottom surface, at least one side surface and said top surface of said first spacer.

14. The image intensifier tube of claim 12, wherein each conductive region disposed on said top surface of said first spacer is positioned in contact with either said first conductive region of said MCP or said second conductive region of said MCP for providing electrical potential to said MCP.

15. The image intensifier tube of claim 14, wherein one of said conductive regions of said MCP extends from a bottom surface of said MCP to a top surface of said MCP for providing electrical potential to said top surface of said MCP, and the other conductive region of said MCP is disposed on said bottom surface of said MCP for providing electrical potential to said bottom surface of said MCP, wherein said bottom surface of said MCP is positioned in contact with said top surface of said first spacer.

16. An image intensifier tube comprising:

a fiber optic substrate defining a planar surface;

a phosphor screen deposited on said planar surface of said fiber optic substrate, a plurality of conductive vias provided through said fiber optic substrate and extending to said planar surface of said fiber optic substrate;

at least one conductive via extending to said planar surface of said fiber optic substrate for providing electrical potential to said phosphor screen;

a spacer positioned on said planar surface of said fiber optic substrate, said spacer defining two conductive regions, wherein each conductive region of said spacer is positioned in contact with a conductive via extending to said planar surface of said fiber optic substrate; and a microchannel plate (MCP) positioned on said spacer, said MCP having a first conductive region positioned in contact with one of the conductive regions of said spacer and a second conductive region positioned in contact with the other conductive region of said spacer for providing electrical potential to said MCP.

17. The image intensifier tube of claim 16 further comprising a getter contact disposed on the planar surface of said fiber optic substrate and conductively coupled to a getter.

18. The image intensifier tube of claim 17 further comprising at least one conductive via provided through said fiber optic substrate and conductively coupled to said getter contact.

19. The image intensifier tube of claim 17 wherein said getter contact is a layer of thin film.

20. The image intensifier tube of claim 16 wherein at least one conductive via comprises a frit seal assembly extending through an aperture disposed within said fiber optic substrate.

21. The image intensifier tube of claim 16 wherein said fiber optic substrate is at least partially composed of glass.

22. The image intensifier tube of claim 16, wherein each conductive region of said spacer extends from a bottom surface of said spacer to a top surface of said spacer.

23. The image intensifier tube of claim 22, wherein said spacer is a substantially flat cylindrical ring comprising said top surface, said bottom surface and two annular side surfaces extending between said top surface and said bottom surface, wherein each conductive region includes a conductive portion defined on said bottom surface, at least one side surface and said top surface of said spacer.

24. The image intensifier tube of claim 22, wherein each conductive region disposed on said top surface of said spacer is positioned in contact with either said first conductive region of said MCP or said second conductive region of said MCP for providing electrical potential to said MCP.

25. The image intensifier tube of claim 24, wherein one of said conductive regions of said MCP extends from a bottom surface of said MCP to a top surface of said MCP for providing electrical potential to said top surface of said MCP, and the other conductive region of said MCP is disposed on said bottom surface of said MCP for providing electrical potential to said bottom surface of said MCP, wherein said bottom surface of said MCP is positioned in contact with said top surface of said spacer.

26. An image intensifier tube comprising:

a ceramic header defining a planar surface;

a silicon imager including silicon disposed on said planar surface of said ceramic header;

a plurality of conductive vias provided through said ceramic header and extending to said planar surface, at least one of said conductive vias being positioned for providing electrical potential to said silicon imager;

a spacer positioned on said planar surface of said ceramic header, said spacer defining two conductive regions, wherein each conductive region of said spacer is positioned in contact with a conductive via extending to said planar surface of said ceramic header; and a microchannel plate (MCP) positioned on said spacer, said MCP having a first conductive region positioned in contact with one of the conductive regions of said spacer and a second conductive region positioned in contact with the other conductive region of said spacer for providing electrical potential to said MCP.

27. The image intensifier tube of claim 26 wherein the silicon imager is a complementary metal oxide semiconductor (CMOS).

28. The image intensifier tube of claim 27, wherein at least one conductive via comprises a frit seal assembly extending through an aperture disposed within said ceramic header and conductively coupled to said complementary metal oxide semiconductor.

29. The image intensifier tube of claim 26 wherein the silicon imager is a charged coupled device (CCD).

30. The image intensifier tube of claim 29, wherein at least one conductive via comprises a frit seal assembly extending through an aperture disposed within said ceramic header and conductively coupled to said charged coupled device.

31. The image intensifier tube of claim 26 further comprising a photocathode assembly including a photocathode disposed on a substrate, and another spacer positioned between said photocathode assembly and said planar surface of said ceramic header.

32. The image intensifier tube of claim 31 wherein said spacers cooperate to provide a spatial relationship among the MCP, photocathode assembly and silicon imager for effective operation of the image intensifier tube.

33. The image intensifier tube of claim 32, wherein said spacers are incorporated into said ceramic header.

34. The image intensifier tube of claim 26 further comprising a getter positioned adjacent the ceramic header.

35. The image intensifier tube of claim 34 wherein said getter is an evaporable getter configured to maintain a vacuum within an interior cavity of the image intensifier tube.

36. The image intensifier tube of claim 34 further comprising a getter shield positioned adjacent to said getter and said ceramic header.

37. The image intensifier tube of claim 26, wherein each conductive region of said spacer extends from a bottom surface of said spacer to a top surface of said spacer.

38. The image intensifier tube of claim 37, wherein said spacer is a substantially flat cylindrical ring comprising said top surface, said bottom surface and two annular side surfaces extending between said top surface and said bottom surface, wherein each conductive region includes a conductive portion defined on said bottom surface, at least one side surface and said top surface of said spacer.

39. The image intensifier tube of claim 37, wherein each conductive region disposed on said top surface of said spacer is positioned in contact with either said first conductive region of said MCP or said second conductive region of said MCP for providing electrical potential to said MCP.

40. The image intensifier tube of claim 39, wherein one of said conductive regions of said MCP extends from a bottom surface of said MCP to a top surface of said MCP for providing an electrical potential to said top surface of said MCP, and the other conductive region of said MCP is disposed on said bottom surface of said MCP for providing an electrical potential to said bottom surface of said MCP, wherein said bottom surface of said MCP is positioned in contact with said top surface of said spacer.

41. A method of assembling an image intensifier tube comprising the steps of:

depositing a phosphor screen on a planar surface of a fiber optic substrate;

positioning a plurality of conductive vias through the fiber optic substrate to extend to the planar surface of the fiber optic substrate, wherein at least one of the conductive vias is positioned to provide electrical potential to the phosphor screen;

positioning a spacer above and in direct contact with the planar surface of the fiber optic substrate;

orienting the spacer such that a first conductive region defined on the spacer is aligned with one of said conductive vias and a second conductive region defined on the spacer is aligned with another of said conductive vias;

positioning a microchannel plate above and in direct contact with the spacer; and orienting the MCP such that a first conductive region of the MCP is aligned with the first conductive region of the spacer and a second conductive region of the MCP is aligned with the second conductive region of the spacer to provide electrical potential to said MCP.

42. The method of claim 41 further comprising the step of fixing the spacer to the microchannel plate via braze, solder or epoxy.

43. The method of claim 41 further comprising the step of positioning a second spacer on the planar surface of the substrate.

44. The method of claim 43 further comprising the step of positioning a photocathode assembly above and in contact with the second spacer.

45. The method of claim 44 further comprising the step of positioning a centering ring around the photocathode assembly, second spacer and fiber optic assembly to substantially enclose the image intensifier tube.

46. The method of claim 45 further comprising the steps of positioning an indium decal between the centering ring and photocathode assembly; and applying pressure to the indium decal to hermetically seal the image intensifier tube.

47. The method of claim 45 further comprising the steps of positioning an indium decal between the centering ring and fiber optic assembly; and applying pressure to the indium decal to hermetically seal the image intensifier tube.

* * * * *